US006285005B1

(12) United States Patent
Aakalu et al.

(10) Patent No.: US 6,285,005 B1
(45) Date of Patent: Sep. 4, 2001

(54) DEVICE FOR HOUSING COMMUNICATION AND ELECTRONIC EQUIPMENT USING POSITIVE TEMPERATURE COEFFICIENT MATERIAL

(75) Inventors: Nandakumar G. Aakalu, Suffern, NY (US); Daniel Plaza, Mendham; Han Q. Truong, Iselin, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/057,806

(22) Filed: Apr. 9, 1998

(51) Int. Cl.[7] ..... H05B 1/00
(52) U.S. Cl. ..... 219/209; 219/385
(58) Field of Search ..... 219/209, 385, 219/210, 478, 537, 505; 237/2 R, 3; 126/273 R, 275 F, 273 E; 340/387.1; 361/701, 704

(56) References Cited

U.S. PATENT DOCUMENTS

| | | | | |
|---|---|---|---|---|
| 3,632,964 | * | 1/1972 | Dapot | 219/209 |
| 3,878,357 | * | 4/1975 | Marcoux | 219/209 |
| 3,898,422 | * | 8/1975 | Fuller et al. | 219/201 |
| 3,900,700 | * | 8/1975 | Gaudet | 174/16 R |
| 4,777,434 | * | 10/1988 | Miller et al. | 324/158 F |
| 4,972,067 | | 11/1990 | Lokar et al. . | |
| 5,010,233 | * | 4/1991 | Henschen et al. | 219/209 |
| 5,064,997 | * | 11/1991 | Fang et al. | 219/505 |
| 5,089,688 | * | 2/1992 | Fang et al. | 219/505 |
| 5,119,215 | * | 6/1992 | Marks et al. | 359/44 |
| 5,508,126 | * | 4/1996 | Braun | 429/7 |
| 5,668,479 | | 9/1997 | Jackson et al. . | |
| 5,828,034 | * | 10/1998 | Chang | 219/209 |

FOREIGN PATENT DOCUMENTS

| | | |
|---|---|---|
| 30 46 995 A | 7/1982 | (DE) . |
| 196 26 778 A | 1/1998 | (DE) . |
| 2 298 995 A | 9/1996 | (GB) . |

* cited by examiner

*Primary Examiner*—Teresa Walberg
*Assistant Examiner*—Daniel Robinson
(74) *Attorney, Agent, or Firm*—Lowenstein Sandler PC

(57) ABSTRACT

An improved enclosure for housing communications and electronics equipment comprises a heating element fabricated with a positive temperature coefficient material. The enclosure is particularly useful for housing communications equipment and cell site base stations for cellular telephone systems in the outdoors; it has self-regulating heating capabilities that are not dependent upon voltage parameters, thereby enabling its use in diverse geographic locations. In a preferred embodiment, a plurality of PTC heating elements are used and selectively located adjacent a plurality of circuitry regions. DC power may be used to energize the PTC heaters, and the enclosure may be used for telephone equipment operating with AC or DC power.

15 Claims, 2 Drawing Sheets

DEVICE FOR HOUSING COMMUNICATION AND ELECTRONIC EQUIPMENT USING POSITIVE TEMPERATURE COEFFICIENT MATERIAL

FIELD OF THE INVENTION

The invention relates to an enclosure for housing communications and electronics equipment using a heating element comprising a positive temperature coefficient material. The enclosure is particularly useful for the outdoor mounting of communications equipment and especially cell site base stations of cellular telephone systems.

BACKGROUND OF THE INVENTION

It is important that a proper operating temperature be maintained within an enclosure that houses an electrical assembly or communications equipment. The equipment often needs to be maintained at or above a minimum operating temperature. For example, certain electronic devices will not operate below 0° C. Yet due to the intended use for the equipment (e.g., a cell site base station for a cellular telephone system), the equipment may have to be mounted outdoors where the ambient temperature may at times drop to below 0° C. or other minimum operating temperature for the equipment.

Traditionally, for equipment mounted outdoors, heaters have been placed in the housings for keeping the equipment sufficiently warm. However, traditional heaters have presented considerable difficulties. One difficulty relates to disabling of the equipment in a cold environment which may be necessitated, for example, when the equipment is inspected for maintenance, repaired, or when there is a power outage. In these cases, it may be necessary to heat the equipment to the minimum operating temperature before reactivation, but to do so, the heater may have to be manually operated. Another difficulty arises because the equipment itself may have heat generating components, or it may be heated from sun rays hitting the assemblies in the outdoors. Traditional heaters are known to create fire hazards. Solar shields have been placed over the devices to prevent an increase in temperature from the sun, but these shields may adversely inhibit the dissipation of heat from the system. Thermostat controls have been placed on the enclosures and regulated externally, that is, in an effort to control the temperature within the enclosure, but regulating the temperature in this fashion produces unstable performance, is not reliable, and generates a relatively high failure rate. Another difficulty with traditional heaters is that presently available heater pads are comprised of materials that will not operate at narrow voltage ranges, placing limits on use of the devices. For example, these systems are not operable for cell site base stations located in Europe or other parts of the world where a high operating voltage (e.g., >110V), is required.

The challenges presented by the outdoor environment coupled with the increased use of outdoor-mounted communications equipment has led to innovative designs for the electrical housing units themselves. For example, a new housing design having heat dissipation fins is described in U.S. Pat. application Ser. No. 09/008,726, "Heat Dissipation Structure for an Electrical Assembly," filed Jan. 1, 1998 by Aakalu et al, and assigned to the present assignee, which is hereby incorporated by reference. See also U.S. Pat. application Ser. No. 08/976,708, "Multi-Layered Polymer Structure For Fabricating Housings For Communications And Electrical Products," by Zimmerman et al., and U.S. Pat. application Ser. No. 08/976,713, "Dual Network Housing Device And Improved Method For Enclosing Networks" both filed Nov. 24, 1997, and assigned to Lucent Technologies, and U.S. Pat. No. 3,900,700 to Gaudet, "Protective Enclosure." All three of the patents cited immediately above are incorporated herein by reference. These devices provide improved heat dissipation features and flame retardant materials. However, it would be advantageous to provide an improved housing that avoids use of traditional heater elements and their associated drawbacks.

SUMMARY OF THE INVENTION

Applicants have discovered an improved enclosure for housing electronics and communications devices in the outdoors that comprises an enclosure having a heating element disposed therein, wherein the heating element is comprised of a material having a positive temperature coefficient (PTC) for generating heat by virtue of the internal resistance of the material when a current is passed through it, and wherein the PTC material is coupled to a power source for generating current. Preferably, the housing is configured for enclosing the circuitry of a cellular telephone cell site base station, and a plurality of heating elements comprising one or more plates of PTC material are selectively located adjacent regions of the circuitry. With the use of PTC material, an enclosure having self-regulating heating capabilities is provided that is not dependent upon voltage parameters, thereby enabling its use in diverse geographic locations.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention and are not to scale.

DETAILED DESCRIPTION OF THE INVENTION

Figure 1:
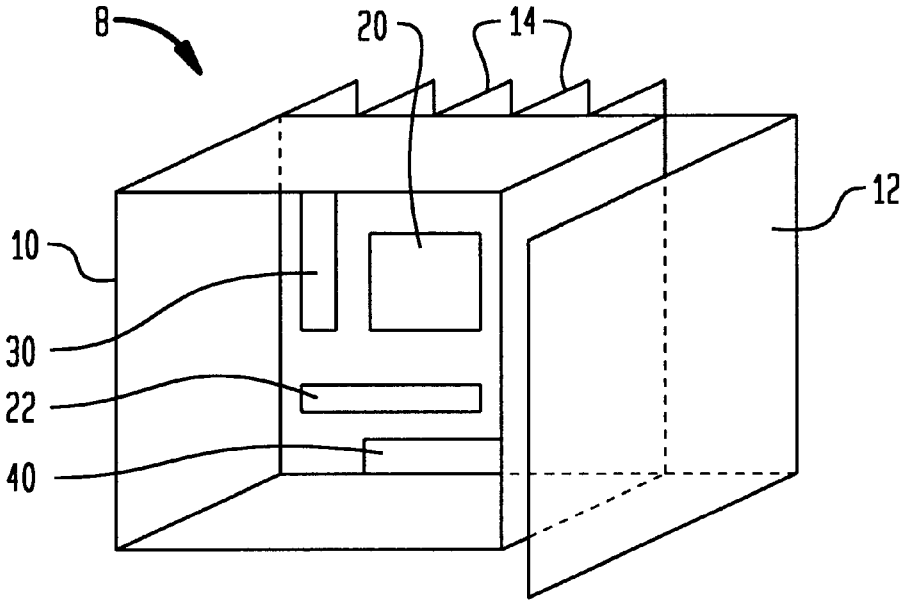
FIG. 1 is a schematic representation of one embodiment of the inventive enclosure having two positive temperature coefficient heaters disposed therein.

Applicants have discovered that an improved enclosure for housing electronics and communications equipment may be configured using a positive temperature coefficient material. A schematic representation of the inventive enclosure is illustrated in FIG. 1. The enclosure unit 8 has an outer structure or exterior wall 10 for encasing the equipment. An access door 12 is provided to gain entry to the interior of the unit, and a plurality of heat dissipation fins 14 are secured to an exterior wall of the unit. Electronic subunits 20, 22, having circuitry disposed thereon are housed within the enclosure. Heating elements 30, 40, comprised of positive temperature coefficient (PTC) thermistor or resistor material are strategically located within the enclosure adjacent the circuitry.

The PTC heating elements may each comprise one or more plates of PTC thermistor or resistor material disposed between a pair of electrodes. Positive temperature coefficient (PTC) heaters comprise solid state semiconductors and generally have been used in consumer products such as hair dryers, clothes dryers, space heaters, automobile mirrors, and the like. A PTC heater comprises a ceramic or polymeric PTC resistor or thermistor material placed in contact with a current generating source, e.g., electrodes. The PTC material produces heat by virtue of the internal resistance generated by the material when a current is passed through it. Some positive temperature coefficient heaters are described, for example, in U.S. Pat. No. 5,658,479 to Tadokoro, "Positive Temperature Coefficient Thermistor Heater and Positive Temperature Coefficient Thermistor Heater Device Using the Same," issued Aug. 19, 1997, and U.S. Pat. No. 4,972,067 to Lokar et al., PTC Heater Assembly and A Method of Manufacturing the Heater Assembly," issued Jun. 21, 1989, both of which are hereby incorporated by reference.

Figure 2:
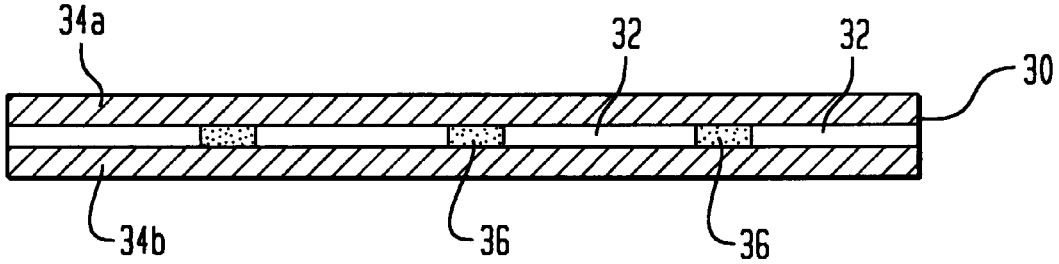
FIG. 2 is a cross-sectional side view of one embodiment of a PTC heating element for use in the inventive enclosure.

FIG. 2 shows the basic configuration of one heating element 30 with more detail than in FIG. 1. The heating element may comprise plates of PTC material 32 separated by insulating material 36, although a single plate of PTC material also may be used. The PTC material is disposed between a pair of electrodes 34*a,* 34*b,* for generating current. The electrodes are connected to a power source (not shown). DC power may be used to energize the PTC heaters, and the enclosure may be used for telephone equipment operating with AC or DC power.

In operation, when a current is passed through the PTC plates 32 by activating the electrodes 34*a,* 34*b,* heat is generated due to the internal resistance of the PTC material. The rate at which the temperature increases or the heat dissipation constant (δ) (i.e., the heat dissipated in a specified period of time by a 1° C. change with ambient temperature), will depend upon the type of PTC material selected, its electrical characteristics, the current generated, and the ambient temperature. The resistance of the PTC material may increase at an exponential or close to exponential rate until a predetermined temperature is reached, at which point the material conducts negligible current, such that heat is no longer generated. In this way, the PTC device is autostabilizing and self-regulating, that is, it autostabilizes at a predetermined temperature. Advantageously, a pair of PTC units may be connected in parallel to each other, sharing a conductive terminal connected to the power source for optimizing heat generation properties relative to the applied power.

Various compositions of materials may be selected for the PTC material, electrodes, or insulating materials, as is known in the field. For example, the PTC material may comprise barium titanate or a carbon paste screen-printed on a polyester firm. The electrodes may comprise aluminum, and the insulating material may comprise polyimide or silicon dioxide. Different dopants or concentrations of dopants may be diffused or implanted into the PTC plates depending upon the predetermined operating temperature desired to be maintained, and the selection of dopants may be determined by those skilled in the field of making PTC materials and heating elements. The heat generating properties of the PTC heating elements may be adjusted depending on the anticipated local temperatures of the ambient in which the enclosure will be placed. Upon specifying the desired operating temperatures and conditions, PTC heating elements may be obtained from Texas Instruments, Inc., Panasonic Corp., Hartford Eichenauer, E.I. duPont de Nemours and Co., or DBK Techniterm of Germany. For a cellular telephone base station, PTC heating elements may be used having a length of about eight inches and a width of about one inch.

Figure 3:
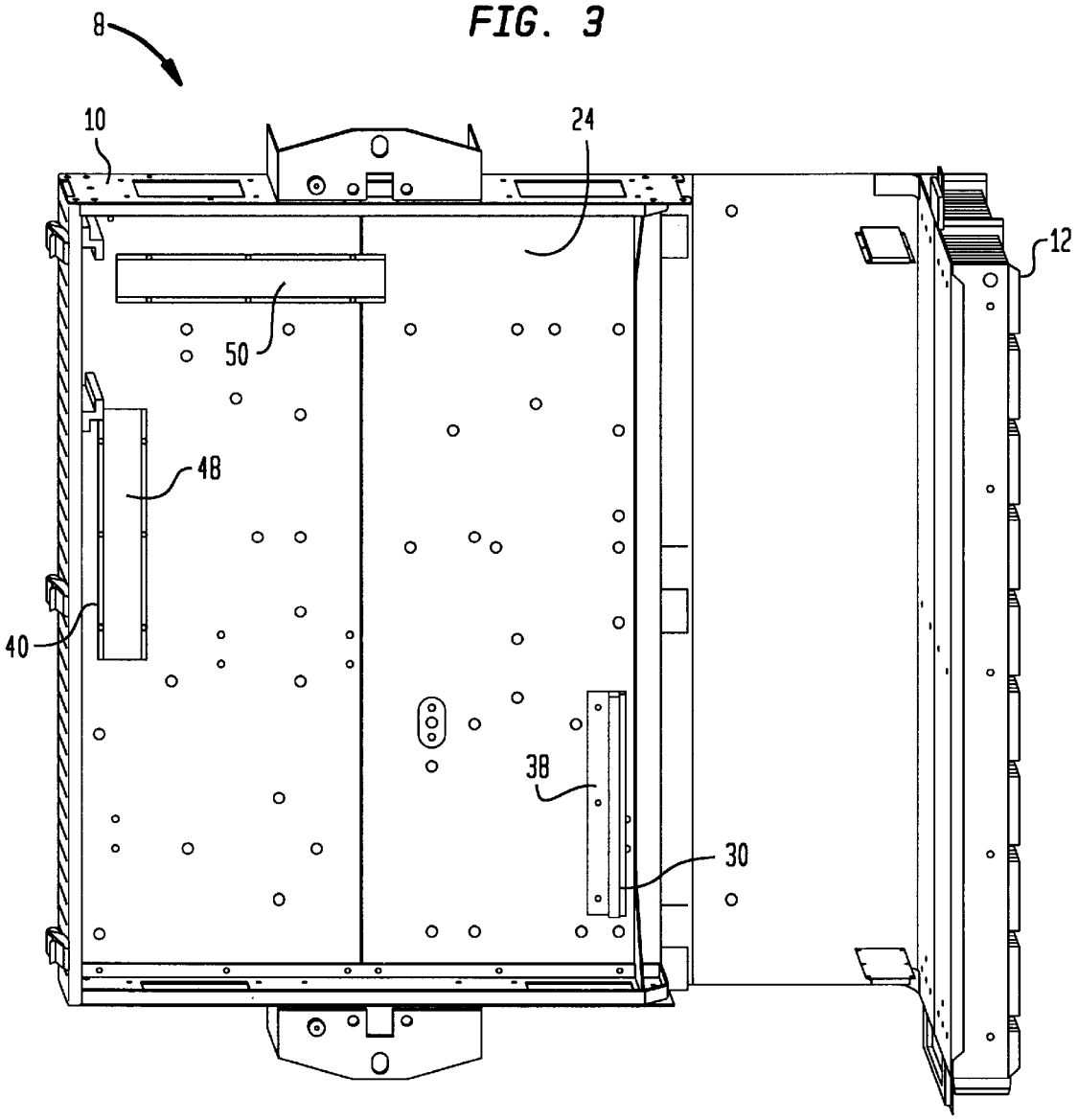
FIG. 3 is a perspective plan view of a circuit board of a cell site base station housed within an inventive enclosure having a plurality of positive temperature coefficient heating elements selectively disposed therein, the enclosure being shown in the open position.

As illustrated in FIG. 3, one or more PTC heating elements 30, 40, 50 may be mounted on brackets 38, 48 and secured to the printed circuit board 24 of an electronics or communications system. Also, the PTC heating elements may be secured to the wall of the enclosure unit 10, or inside the door 12, instead of, or in addition to, being installed on the printed circuit board 24. As shown, advantageously one or more heating elements comprised of materials having different temperature coefficients are selected and strategically placed within the enclosure to provide for distributed and controlled heating. For example, in the case of a cell telephone base station, the heating element placed near the high power RF amplifier may be selected as comprising a material that will not dissipate heat during normal operating conditions, whereas the heating element or elements placed near the circuit packs should dissipate heat when the ambient temperatures are at about 0° C. or lower. The heating elements may be fabricated to be flexible, increasing the mounting capabilities within the enclosure.

All heating elements preferably should dissipate heat when the unit is activated for the warm-up stage, i.e., when the unit is heated to initiate its operation. The PTC heating elements may be configured to automatically activate upon reaching a threshold minimum temperature, such that external activation is not required. For the cell telephone base station, the heater output should be insensitive to the input voltages. In this way, the same heater assembly may be used regardless of the AC voltage at which each particular cell base station operates, and thus, the same type of enclosure unit may be used at various geographic locations. The elements of the circuitry and their heat generating properties are well known such that the selective placement of the PTC elements may be performed by one skilled in the field. Cell base station circuitry also is described in U.S. Pat. No. 5,613,234, issued Mar. 18, 1997 to Vella-Coleiro, "Receive Filter Using Frequency Translation for or in Cellular Telephony Base Station," assigned to Lucent Technologies, Inc., the present assignee, which is incorporated herein by reference.

The PTC elements may be selectively located based not only on the circuitry of the device but also on the components of the housing. For example, a housing may be used as described in U.S. patent application Ser. No. 09/008,726, incorporated herein above; that is, the housing may have an array of heat conducting fins secured to an exterior wall of the enclosure and a perforated cover over the fins. The PTC elements may be selectively placed on the enclosure wall, such as a wall distal the heating conducting fins.

Use of the PTC heating elements provides advantages as external thermostat controls are no longer needed. The heaters may be left on at all times, and it is not necessary that they be activated or deactivated externally to avoid cooling problems. The inventive enclosure having the PTC heating element has enhanced reliability as compared with traditional devices with thermostat controls, and passive control over temperature is achieved. Safety is enhanced; due to the self-regulating nature of the heaters, the possible risk of fire hazards is reduced. Heater output may be insensitive to the input voltage to provide a more versatile device usable in more diverse geographic locations.

It is understood that the embodiments described herein are merely exemplary and that a person skilled in the art may make variations and modifications without departing from the spirit and scope of the invention. All such variations and modifications are intended to be included within the scope of the appended claims.

We claim:

1. An enclosure for housing electronics or communications equipment having a minimum operating temperature, the enclosure comprising:

a housing having a plurality of sidewalls, wherein each of the Plurality of sidewalls has an exterior surface and an interior surface and the interior surfaces of the plurality of sidewalls define an internal cavity for housing the electronics or communications equipment within a surrounding ambient;

at least one heater assembly disposed within the internal cavity in open communication with the ambient, the heater assembly comprising at least one plate of positive temperature coefficient (PTC) material disposed between a pair of electrodes, the electrodes being connected to a source of power for generating current through the PTC material, wherein the heater assembly is adapted to maintain the ambient at a temperature equal to or above the minimum operating temperature of the electronics or communications equipment during operation of the equipment when the housing is mounted outdoors.

2. The enclosure of claim 1 in which the PTC material comprises a thermistor or resistor material.

3. The enclosure of claim 1, in which the at least one heater assembly comprises a plurality of plates of PTC material, each of the plurality of plates of PTC material being separated from each other by at least one plate of insulating material, wherein the plurality of plates of PTC material and the at least one plate of insulating material are arranged along a longitudinal axis and disposed between the pair of electrodes.

4. The enclosure of claim 3, in which a plurality of heater assemblies are selectively disposed in the internal cavity adjacent the equipment.

5. The enclosure of claim 4, in which the equipment comprises at least one printed circuit board, and the plurality of heater assemblies are selectively mounted on the printed circuit board.

6. The device of claim 4 in which a plurality of heater assemblies are selectively mounted to one or more of the interior surfaces of the enclosure.

7. A cellular telephone base station comprising the improved enclosure of claim 1.

8. A cellular telephone base station comprising the enclosure of claim 6.

9. The enclosure of claim 1 wherein the at least one heater assembly is adapted for maintaining the electronics or communications equipment at the temperature equal to or above the minimum operating temperature while the equipment is mounted in the outdoors.

10. The enclosure of claim 1 in which the at least one heater assembly is actuated continuously during operation of the equipment.

11. The enclosure of claim 1 in which a plurality of heater assemblies are disposed within the internal cavity, and at least one of the plurality of heater assemblies comprises a PTC material having a temperature coefficient different from the temperature coefficient of a PTC material of another one of the plurality of heater assemblies.

12. The enclosure of claim 1 comprising at least one pair of heater assemblies arranged in parallel to each other sharing a conductive terminal connected to the power source.

13. The enclosure of claim 5 in which the at least one heater assembly is mounted on a bracket that is secured to the printed circuit board.

14. An enclosure adapted for housing equipment comprising a cellular telephone base station, the equipment including a receiver, a filter, an amplifier and a transmitter, the enclosure comprising:

a housing having a plurality of sidewalls defining an internal cavity and an enclosed ambient, the internal cavity being adapted for receiving the equipment in communication with the ambient;

at least one heater assembly mounted within the internal cavity adjacent the equipment and in open communication with the ambient for maintaining the ambient at a temperature at or above the minimum operating temperature of the equipment when the equipment is housed outdoors, the at least one heater assembly comprising a plurality of plates of PTC material, wherein each plate of PTC material is separated from another plate of PTC material by an insulating material, the plurality of plates of PTC material and insulating material being disposed between a pair of electrodes connected to a power source, wherein the at least one heater assembly is actuated continuously during operation of the equipment and is self-regulating such that the equipment is maintained at a temperature equal to or above the minimum operating temperature of the equipment while the equipment is operated in the outdoors, without manual operation of the at least one heater assembly.

15. The enclosure of claim 14, in which the operation of the at least one heater is not affected by input voltages to the cellular telephone base station.

* * * * *